US006702218B1

(12) United States Patent
Schmodde et al.

(10) Patent No.: US 6,702,218 B1
(45) Date of Patent: Mar. 9, 2004

(54) THREAD-FEED DEVICE, COMPRISING AN ADJUSTABLE THREAD-GUIDE UNIT

(75) Inventors: Hermann Schmodde, Horb-Dettlingen (DE); Richard Kaufmann, Freudenstadt (DE)

(73) Assignee: Memminger-IRO GmbH, Dornstetten (DE)

( * ) Notice: Subject to any disclaimer, the term of this patent is extended or adjusted under 35 U.S.C. 154(b) by 0 days.

(21) Appl. No.: 10/030,791

(22) PCT Filed: Jul. 7, 2000

(86) PCT No.: PCT/DE00/02229

§ 371 (c)(1),
(2), (4) Date: Mar. 28, 2002

(87) PCT Pub. No.: WO01/04403

PCT Pub. Date: Jan. 18, 2001

(30) Foreign Application Priority Data

Jul. 12, 1999 (DE) ..... 199 32 482

(51) Int. Cl.[7] ..... B65H 51/02; B65H 57/00

(52) U.S. Cl. ..... 242/366; 242/157 R; 242/419.4; 242/364.5

(58) Field of Search ..... 242/366, 364.5, 242/419.4, 157 R

(56) References Cited

U.S. PATENT DOCUMENTS

| | | | | | |
|---|---|---|---|---|---|
| 3,883,083 | A | | 5/1975 | Rosen | |
| 4,028,911 | A | * | 6/1977 | Fecker et al. | 242/364.5 |
| 4,153,213 | A | * | 5/1979 | Jacobsson | 242/364.5 |
| 4,361,292 | A | | 11/1982 | Fecker et al. | |
| 4,632,324 | A | * | 12/1986 | Gutschmit | 242/364.5 |
| 4,691,873 | A | * | 9/1987 | Gutschmit | 242/364.5 |
| 5,860,298 | A | * | 1/1999 | Chen | 66/132 T |
| 6,131,841 | A | * | 10/2000 | Jang | 242/365.6 |
| 6,270,032 | B1 | * | 8/2001 | Chen | 242/364.5 |
| 6,283,397 | B1 | * | 9/2001 | Chen | 242/366 |

FOREIGN PATENT DOCUMENTS

| | | | |
|---|---|---|---|
| DE | 30 06 197 | A1 | 8/1981 |
| DE | 35 16 891 | C1 * | 10/1986 |
| DE | 36 16 891 | C | 11/1987 |
| DE | 41 16 497 | A1 | 11/1992 |
| FR | 2188588 | A * | 2/1974 |
| GB | 2 169 927 | A | 7/1986 |

* cited by examiner

*Primary Examiner*—Michael R. Mansen
(74) *Attorney, Agent, or Firm*—Leydig, Voit & Mayer, Ltd.

(57) ABSTRACT

A modular yarn feeder having a basic carrier on which additional modules can be secured as needed by suitable coupling devices. This makes the yarn feeder more adaptable to different kinds of use and different situations.

16 Claims, 10 Drawing Sheets

THREAD-FEED DEVICE, COMPRISING AN ADJUSTABLE THREAD-GUIDE UNIT

FIELD OF THE INVENTION

The invention relates to a yarn feeder for textile machines.

BACKGROUND OF THE INVENTION

Yarn feeders are used to feed yarns to yarn using stations, such as individual knitting stations in loop-forming textile machines. The yarn feeders are separate devices, which must be secured in great numbers to the machine. Depending on the use, special demands may ensue for the yarn feeder that require a certain adaptation. From the standpoint of the manufacturer of the yarn feeder, it is therefore expedient if the yarn feeders are easily adaptable to different situations, which can result from the type of textile machine used in a given case or from a particular practical use. Adaptation should be feasible at the least possible expense and with the simplest possible means.

OBJECT AND SUMMARY OF THE INVENTION

The invention is carried out by a yarn feeder having an adjustable yarn guide arrangement. The latter includes a yarn guide element, such as a yarn eyelet, which can be adjusted between two different oblique draw-off positions relative to the yarn guide drum. Drawing the yarn off obliquely enables the traveling yarn to keep the yarn guide drum clean. The adjustment is affected along a specified path. Thus the yarn guide element can be moved to at least two different positions, in which the yarn travels along the lower rim of the yarn guide drum at different angles. With a comparatively shallower payout course, that is, in a first position in which the yarn guide element is relatively high or in other words is only slightly below the lower rim of the drum, but in turn is at a greater horizontal spacing from it, the yarn being paid out separates relatively slowly from the windings located on the yarn guide drum and is then paid out along the lower rim of the drum. This prevents the situation in which the yarn being paid out could tear the windings on the yarn guide drum down along with it. In this mode of operation, the yarn feeder is especially suitable for spun yarns, in which windings located side by side adhere relatively strongly to one another because of the filaments protruding from the yarn.

In a second position, the yarn guide element is at a comparatively great vertical spacing from the lower rim of the yarn guide drum but in turn is set at a lesser horizontal spacing from the pivot axis. The yarn being paid out is drawn downward relatively steeply, so that it sweeps firmly over the lower rim of the yarn guide drum. In this mode of operation, fluff deposits and rings of fiber, which could form on the lower rim of the yarn guide drum, are swept off especially well. This operation is especially suitable for continuous-filament yarns.

The advantage of the adjustable yarn guide element is that the payout angle of a yarn guided by the yarn guide element is adjustable. If the yarn is changed, for instance by being cut upstream of the yarn feeder and with a new yarn being spliced to the remaining end of the old yarn, then the new yarn travels through the yarn feeder to the textile machine without having to be threaded in manually. The yarn guide element can be adapted accordingly in its position to the filament properties of the yarn.

Another advantage is attained if an existing yarn feeler lever (i.e. shutoff means) is capable of functioning in both adjusting positions of the yarn guide element without having to be repositioned. For instance, one yarn feeler lever is disposed such that it scans the yarn in the vicinity of a fixed yarn eyelet. Any adjustment of the yarn guide element does not substantially shift the switching point of the yarn feeler.

The yarn feeder is furthermore preferably modularly designed. The basic device has a basic carrier, which on one end has a fastening device that is arranged for connection to the textile machine, and that at a point spaced apart from this has a rotatably supported, preferably vertically disposed shaft. The shaft is arranged on one end for connection to a yarn guide drum and on its other end is provided with a drive device. This device may be embodied by a pulley or the like.

A coupling device is provided on the yarn feeder, and additional modules can be connected to it. Thus the yarn feeder can be adapted to different kinds of use by means of a plurality of modules. Beginning with a basic device, a construction kit can thus be created, with which a number of additional modules can be made. For the yarn feeder manufacturer, this means that the many types required can be made using only a few basic elements.

Essentially, the yarn feeder is formed as a basic device by the parts that are each needed in a large number of applications. These include the basic carrier, its fastening device for connection to a machine, and a rotatably supported shaft along with a drive device, and a yarn guide drum that is preferably secured interchangeably to the shaft. Additional parts are connected to the basic carrier via one or more coupling devices. The coupling devices are disposed for instance on both sides of the shaft., which makes greater freedom of design possible for the mounting of additional modules.

The coupling device is preferably assigned a retaining device, with which the counterpart is retained in its desired position. The retaining device may be a clamping device, detent device, or other kind of fastening means. The clamping device can for instance be formed by a chucking device, which deforms the guide device somewhat and thus brings about clamping by frictional engagement. The result is secure bearing of the additional module and large-area transmission of force as well as seating of the additional module without rattling. The large-area force transmission makes it possible to embody the coupling device of the same plastic as the basic carrier, even if the coupling device is required to transmit some forces.

The additional module can be provided for receiving further elements, which are preferably retained interchangeably. If the additional module is a retainer that protrudes freely, for instance, then different yarn guide elements can be secured to it. Bearings for further supporting the shaft on the retainer can also be provided, if necessary.

Another additional module may for instance be a yarn brake. Depending on the application, various types of brake can be kept on hand (driven, nondriven, with magnetic clamping of the brake elements, spring clamping, etc.). A further fixture module may be a friction module, which in addition to a friction drum that feeds the yarn by frictional engagement has means for defining the wrap angle of the yarn around the yarn guide drum. For bearing the yarn guide means or similar parts that belong to the friction drum, suitable connection means may also be provided on the underside of the basic carrier. The basic carrier is preferably formed by a two-shell housing, which is divided approximately horizontally. The housing parts are then separably joined to one another, and as a result the housing interior becomes accessible. Additional devices, such as electric switches, circuits, bearings for yarn feeler levers and the like, can be accommodated in the housing interior.

Other objects and advantages of the invention will become apparent upon reading the following detailed description and upon reference to the drawings, in which:

DETAILED DESCRIPTION OF THE DRAWINGS

FIGS. 10 and 11 are fragmentary perspective views of housing parts of the illustrated yarn feeder.

Figure 1:
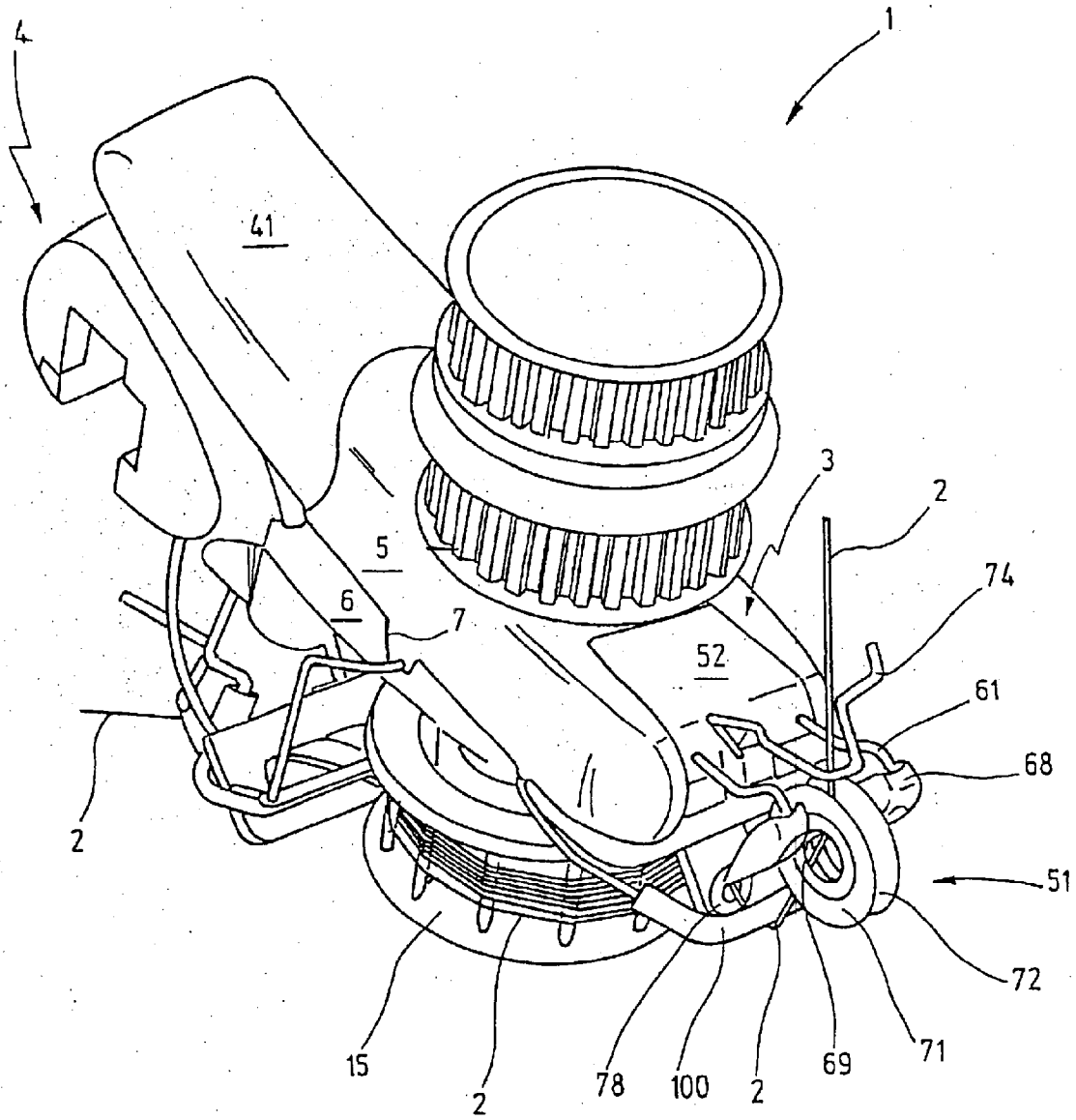
FIG. 1 is a perspective of a modular yarn feeder in accordance with the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

The yarn feeder has a basic carrier, embodied as a housing, with a fastening device 4 that serves to secure the yarn feeder 1 to a suitable retaining device, such as the retaining ring of a knitting machine.

The housing is constructed of two shells and has an upper housing part 5 and a lower housing part 6, which abut one another or fit in one another at a dividing seam 7. As seen from FIG. 2, the housing, which serves as a basic carrier 3 has two bearing seats 9, 10 for ball bearings 11, 12 for rotatably supporting a shaft 14. The shaft is oriented approximately vertically and has a yarn guide drum 15 mounted on its lower end. This drum is preferably embodied in one piece as a deep-drawn sheet-metal part or as a ceramic part. By means of a retaining screw 17 screwed axially into a blind bore 16 of the shaft 14, the drum is joined to the shaft 14 in a manner that prevents relative rotation. One or more drive disks 18, 19 are disposed on the upper end of the shaft 14; via bearing devices. The disks 18, 19 are rotatably supported on the shaft 14, and they can be coupled to the shaft for rotation as needed by means of a coupling disk 21.

The bearing seats 9, 10 are formed by tubular extensions on the upper and lower housing parts 5, 6. They are aligned with one another and have a cylindrical chamber, opening toward the outside, for receiving the respective ball bearing 11, 12. To assure the alignment of the two bearing seats 9, 10 to one another, a tubular extension 22 extending through the interior of the housing and surrounding the shaft 14 is provided on the lower housing part 6. The tubular apperture 22 engages a corresponding receptacle 23 formed in the upper housing part 5 the extension 22 and the receptacle 23 fit together without play in one another.

Figure 3B:
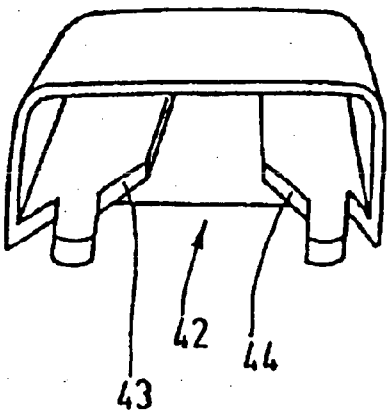
FIGS. 3A and 3B are perspectives of components of the coupling device of the illustrated yarn feeder.
Figure 3A:
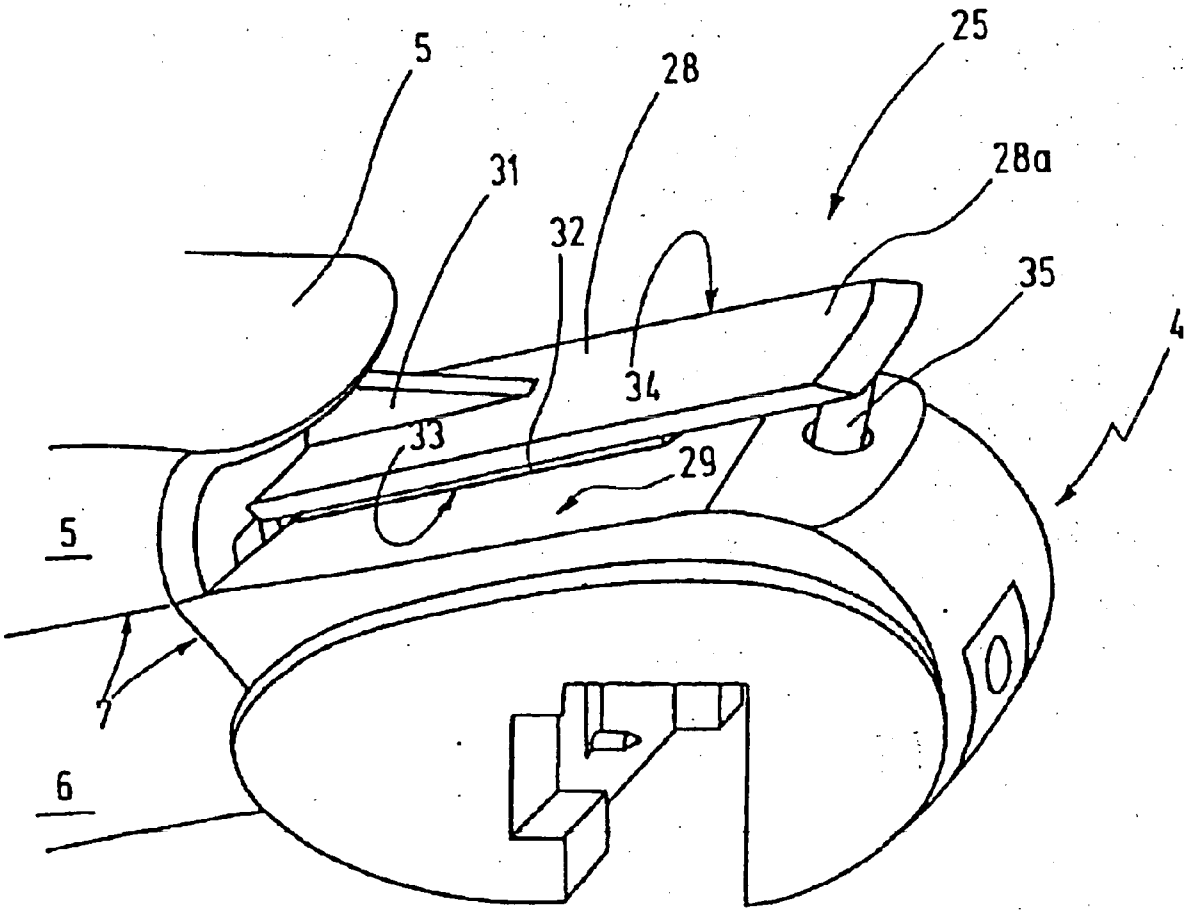

A plurality of coupling devices 27 for securing additional modules are provided on the basic carrier 3. The coupling device 25 is embodied on the basic carrier 3 between the shaft 14 and the fastening device 4 and is shown separately in FIG. 3. The coupling device 25 includes a guide plate 28, which is disposed parallel to a housing face 29 and is solidly joined to the housing part 5 via ribs 31, 32. The guide plate 28, with the guide face 29 and with its side toward the guide face 29, defines two guide grooves 33, 34.

A portion 28*a* of the guide plate 28 protruding freely past the rib 32 forms a fastening or clamping device for a foot that is meant to be slipped onto the guide plate 28. Leading through an opening 37 is a fastening screw 38 whose head is braced on a suitable annular shoulder 39 formed on the lower housing part 6. If the screw 38 is tightened, this causes a certain deformation of the guide plate portion 28*a*.

Figure 2:
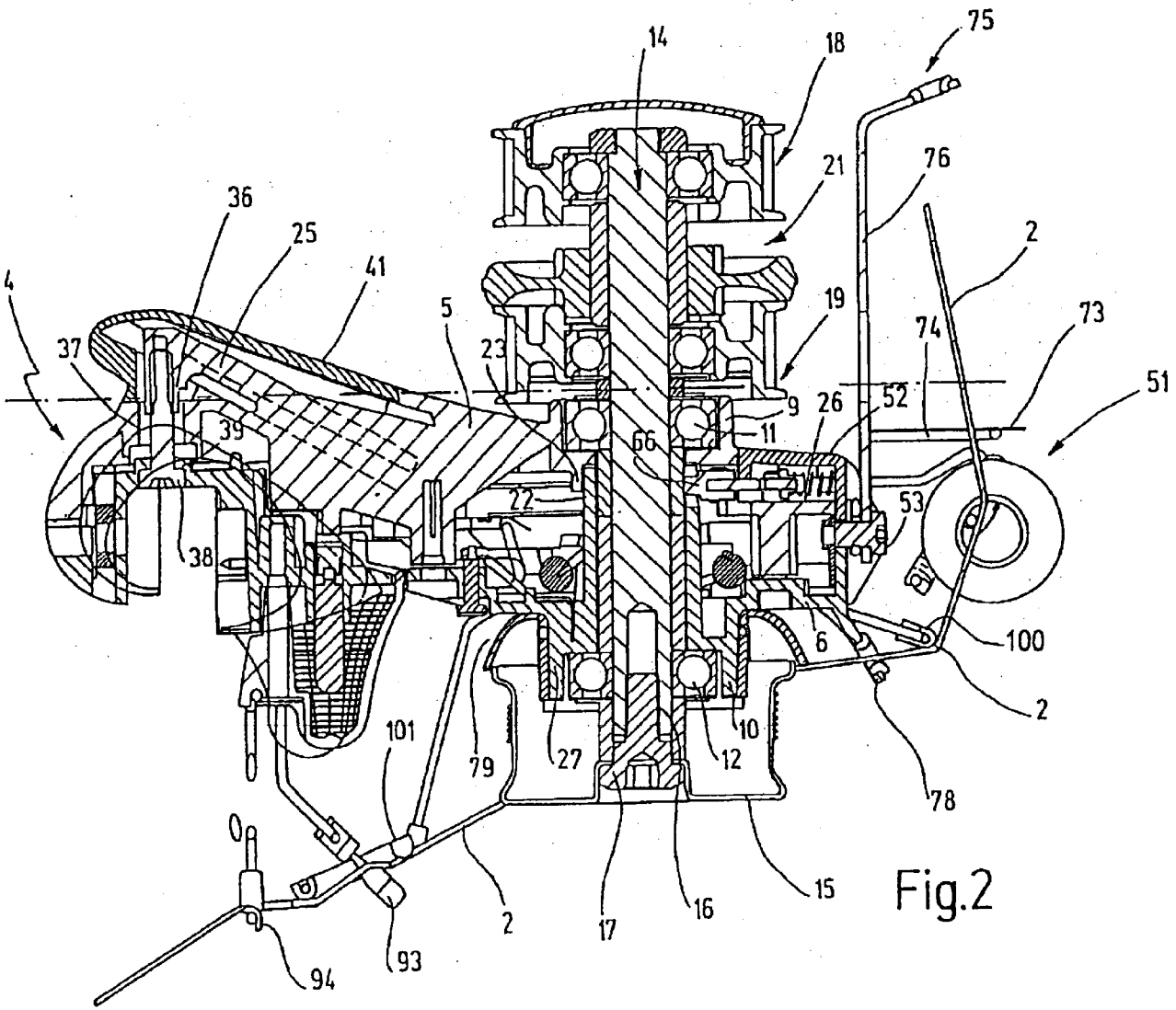
FIG. 2 is an enlarged vertical section of the yarn feeder shown in FIG. 1, provided with additional parts.

In the yarn feeder shown in FIGS. 1 and 2, the coupling device 25 includes a blind cap 41, which if needed completely covers the coupling device 25. The clamshell-like blind cap 41 has an interior 42, in which two opposed clamping cleats 43, 44 extend that define a slit. These cleats are arranged for being thrust into the guide grooves 33, 34. Once the blind cap 41 has been slipped in this way onto the coupling device 25, the fastening screw 38 can be tightened, causing the portion 28*a* to firmly clamp the blind cap 41 with its clamping cleats 43, 44. In the same way as the blind cap 41, other additional modules can be secured to the coupling device 25 and have a foot whose internal shape conforms to the internal shape of the blind cap 41. One such additional module can be seen in FIG. 5. A retainer 46 is secured on the basic carrier 3 and fits over the drive disks 18, 19; on its free end 47, it has a spring clamp 48 for securing a yarn guide tubule 49. Still other devices can be secured to the arm 46 as needed.

The coupling device 26 shown in FIG. 2 serves for instance to secure a brake module 51. The coupling device 26 is formed by an approximately rectangular recess or pocket, into which the brake module is inserted by a base 52. The base 52 is guided and positioned by the side faces of the recess formed in the housing part 5. By means of a clamping screw 53, provided in the immediate vicinity of the recess, the base 52 is retained in the recess.

Figure 4:
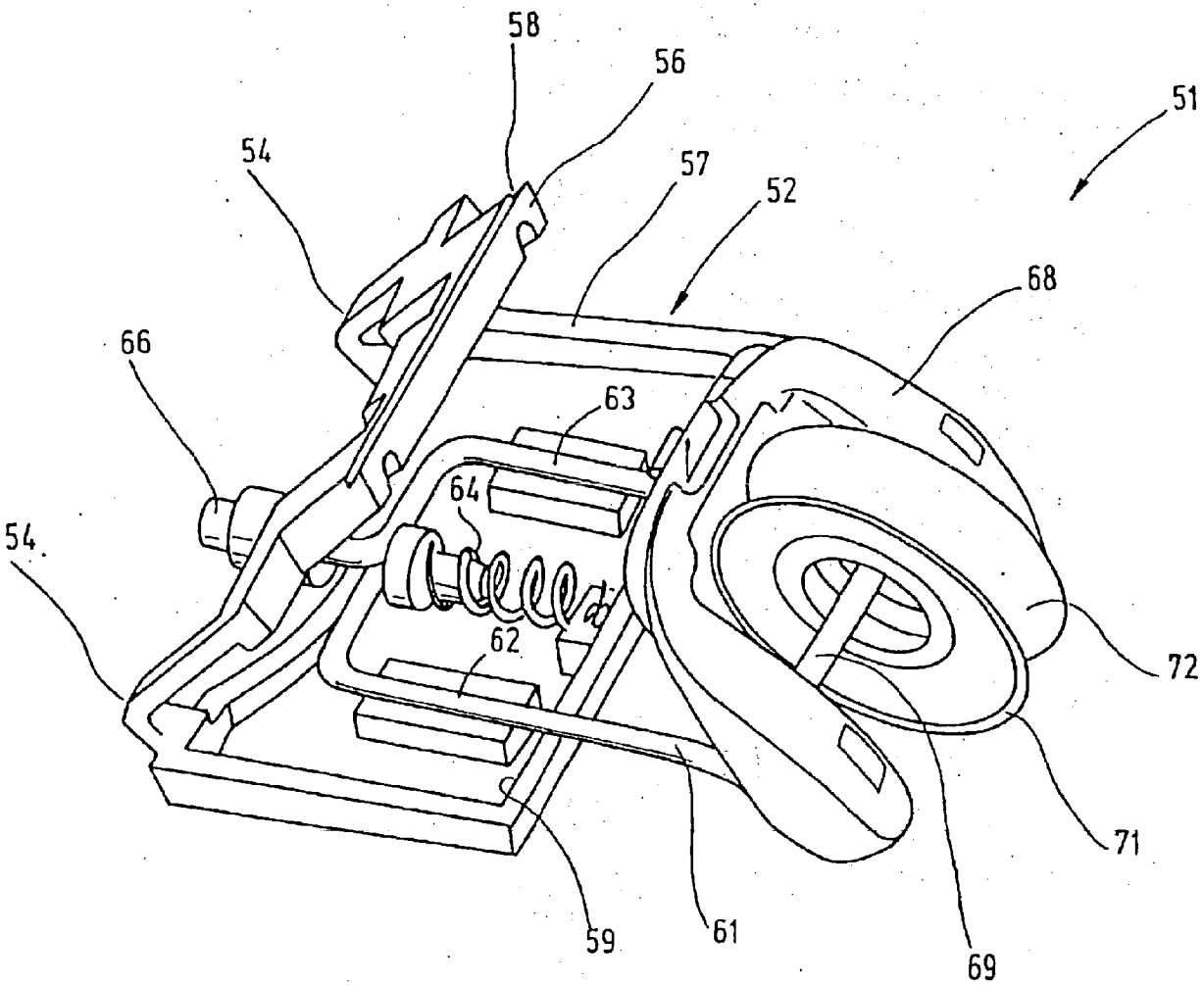
FIG. 4 is a perspective of a yarn brake that can be used with the illustrated yarn feeder.

The break module 51 is shown separately in FIG. 4. Its base 52 has two parts 56, 57, which are joined via a film hinge 54 and can be locked to one another. This purpose is served by a detent cleat 58, formed on the front free face end of the part 56, and a corresponding detent recess 59 in the other part 57 is associated with this cleat.

The two parts 56, 57 serve the purpose of an axially displaceable bearing of a brake carrier 61, which is formed by a bent wire element. This element has two legs 62, 63, parallel to one another, which are displaceably supported in suitable guides. The leg 62 is braced on the part 57 via a compression spring 64 and prestresses the brake carrier 61 in one direction (toward the shaft 14; see FIG. 2). On its free end, the leg 62 has a tappet 66, which cooperates with a cam provided on the shaft 14.

Outside the base 62, the brake carrier 61 is provided with a molded yarn guide piece 68, which via a rib 69 carries two brake disks 71, 72, which are supported freely rotatably on the rib. The break disks 71, 72 adhere magnetically to one another.

Additional fixtures may be a knot catcher 73 and a yarn inlet eyelet 74, which are both retained by the fastening screw. As FIG. 1 shows, the yarn inlet eyelet 74 is open, so that the yarn 2 can simply be placed in it from the side. The knot catcher 73 is formed for instance by a metal sheet provided with a narrow slit. The fastening screw 53 can also serve to retain a yarn inlet eyelet 75, which is disposed on an arm 76 above the drive disk 18.

Figure 6:
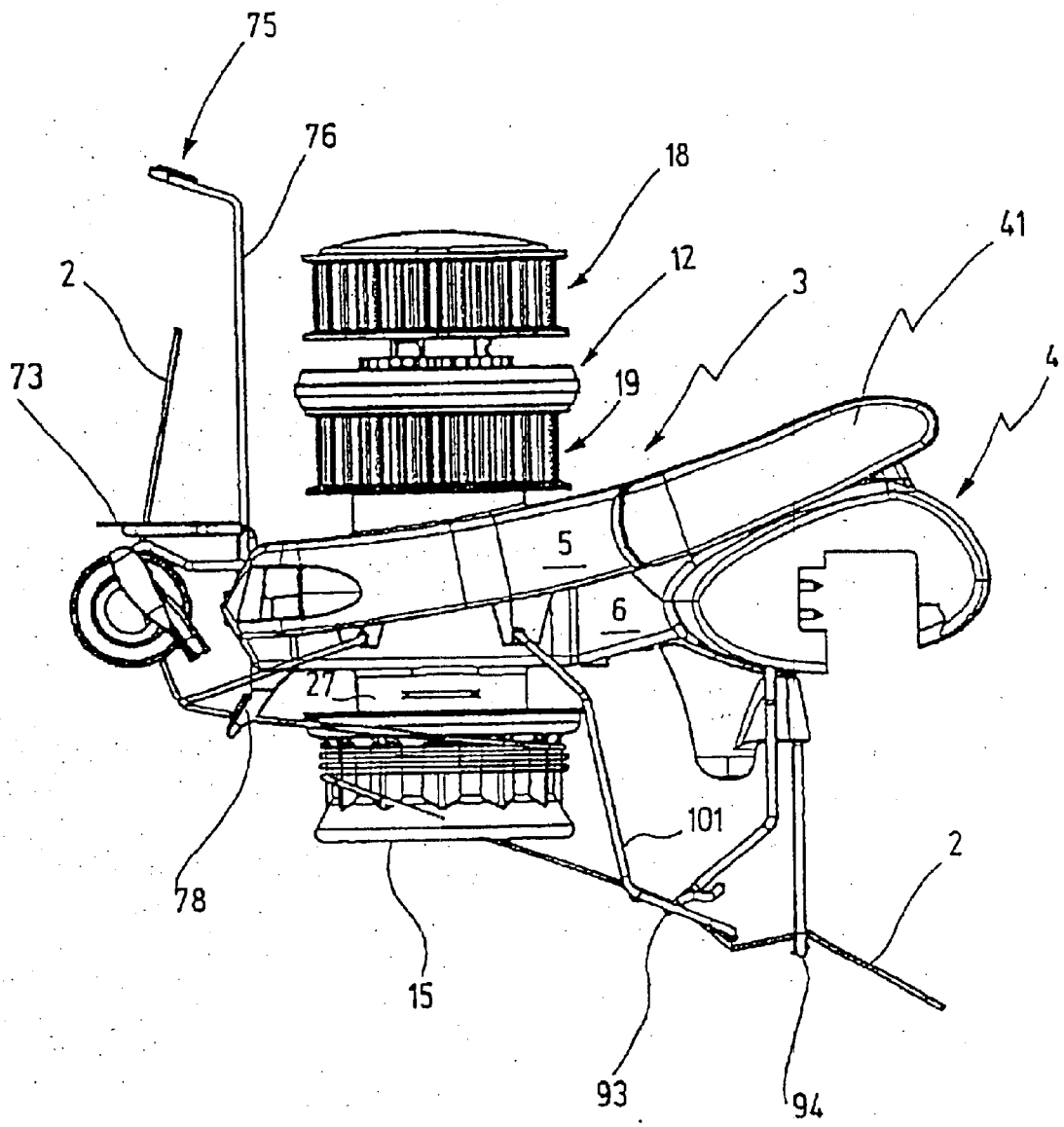
FIG. 6 is a further side elevational view of the illustrated yarn feeder.
Figure 7:
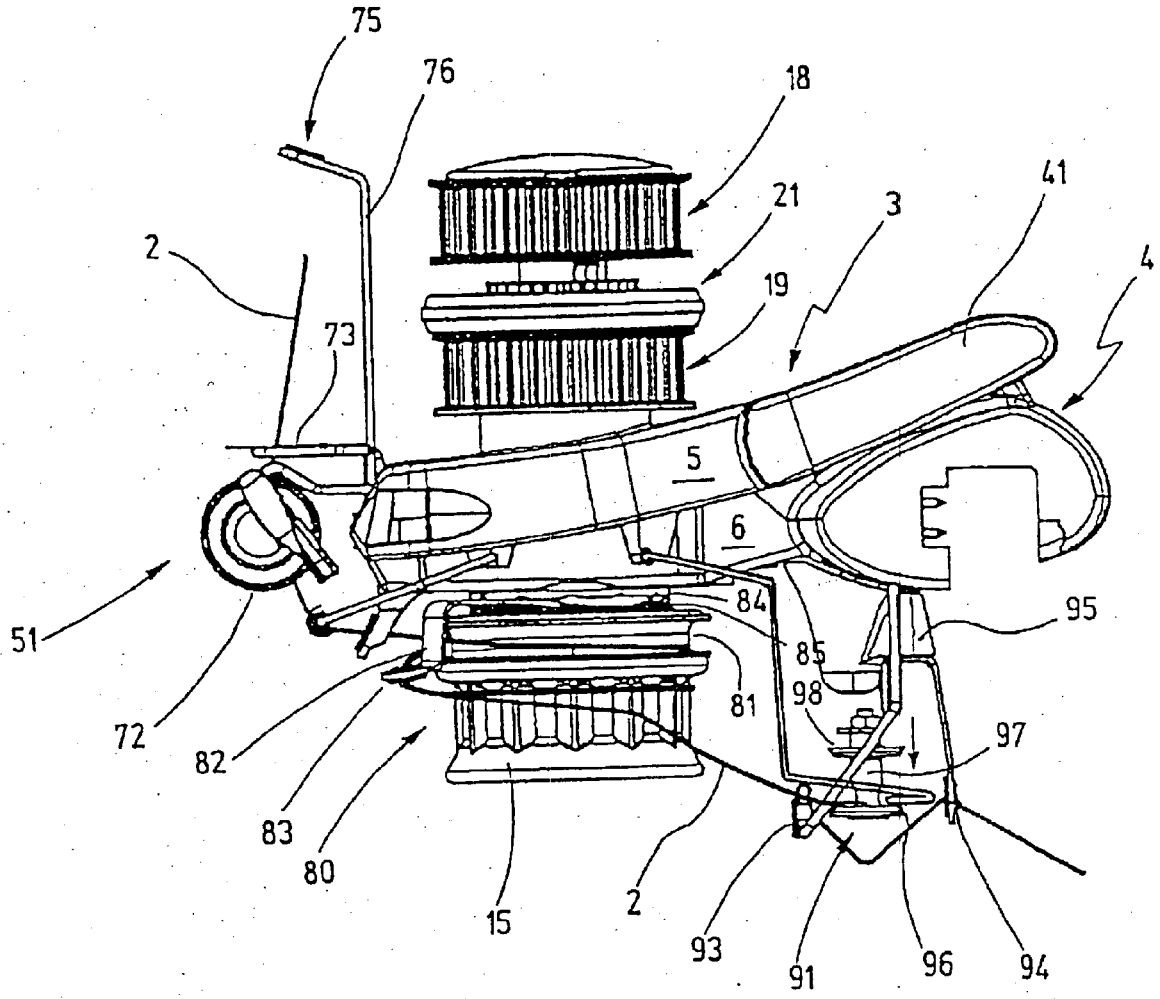
FIG. 7 is a side elevational view of the illustrated yarn feeder equipped with a friction feeder.

The coupling device 27 is formed by the outer conical or cylindrical face of a tubular extension, which extends into the interior of the yarn guide drum 15. As FIG. 6 or FIG. 2 also shows, the yarn guide drum 15 is therefore placed with its upper rim relatively far away from the underside of the housing part 6, approximately at the same level as a yarn guide eyelet 78, which is molded as a fixed yarn guide eyelet on the lower housing part 6. The interstice can be closed by a cover hood 79, which is slipped for instance onto the extension 10. As FIG. 7 shows, the yarn guide drum 15 can be supplemented with or replaced by a friction module 80. The friction module 80 includes the yarn guide drum 15 and a friction disk 81 joined to the drum in a manner fixed against relative rotation. The friction unit 80 also includes a setting lever 82, which has a yarn guide eyelet 83 at approximately the level of the transition between the friction disk 81 and the yarn guide drum 15 and otherwise extends radially to the pivot axis of the shaft 14. For pivotable bearing of the lever 82, clamping rings 84, 85 are slipped onto the coupling device 27 and seated on it; between them, they clamp an annular bearing region of the lever 82. The annular bearing region may be provided with one or more protrusions that engage corresponding recesses in the clamping rings 84, 85, in order to fix the lever 82 in various detent positions.

In order to set the yarn feeder 1 for friction operation, in many cases an outlet brake 91 is expedient or required. This brake is preferably disposed between two yarn guide eyelets 93, 94 on the outlet side. For fastening the outlet brake 91 detachably to the yarn feeder, a base 95 is used, which is provided with a threaded opening and is located below the fastening device 4. This allows the outlet brake to be screwed on. It has a lower, approximately horizontally disposed brake disk, which is carried by a pin 97 provided with an opening. An upper brake plate is supported displaceably in the direction of the arrow on this pin and can be locked in its upper position. This disk, by its own weight, presses the yarn 2 against the brake disk 96.

Figure 8:
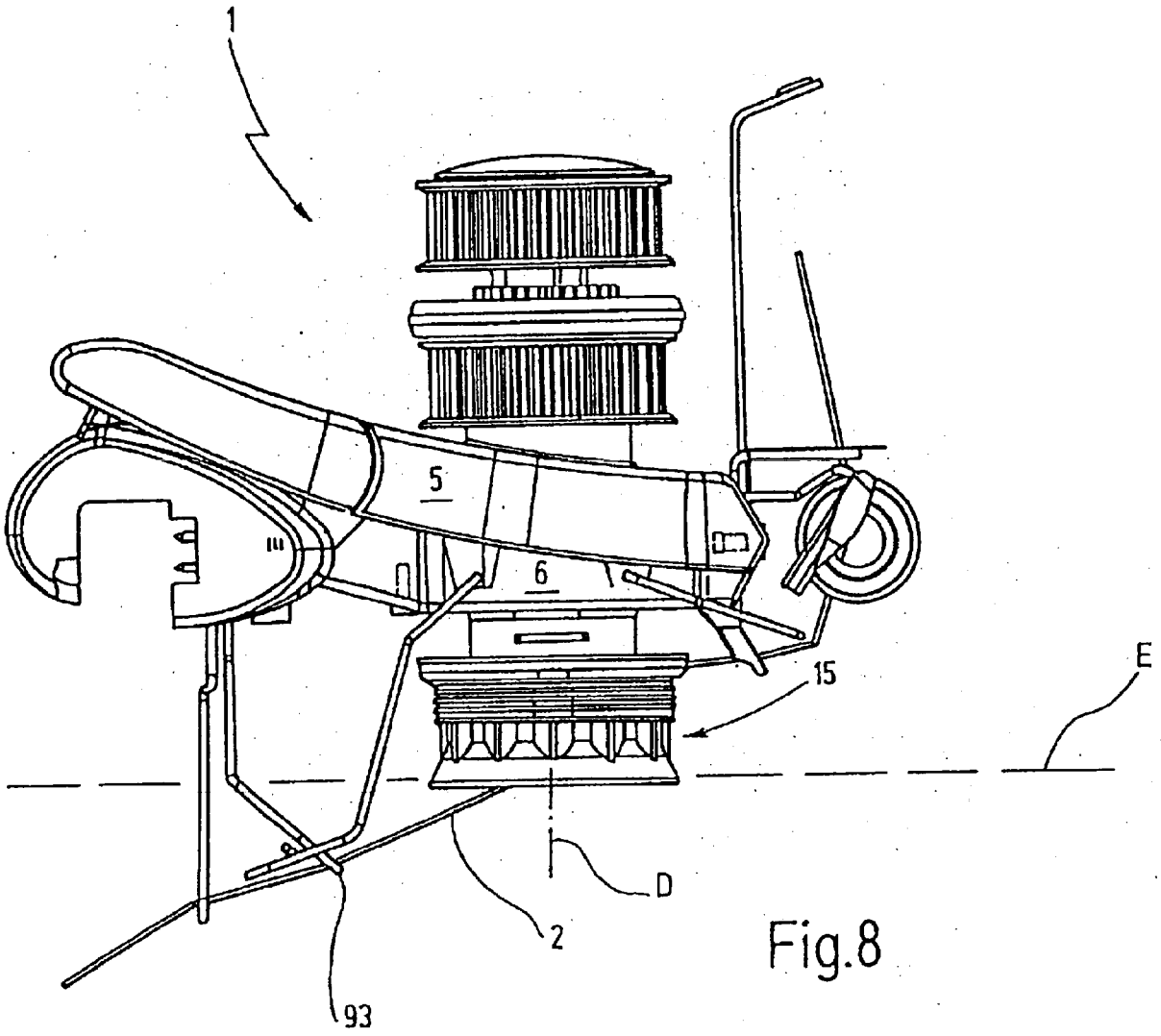
FIG. 8 is a side elevational view of the illustrated yarn feeder set for use with spun yarn.
Figure 9:
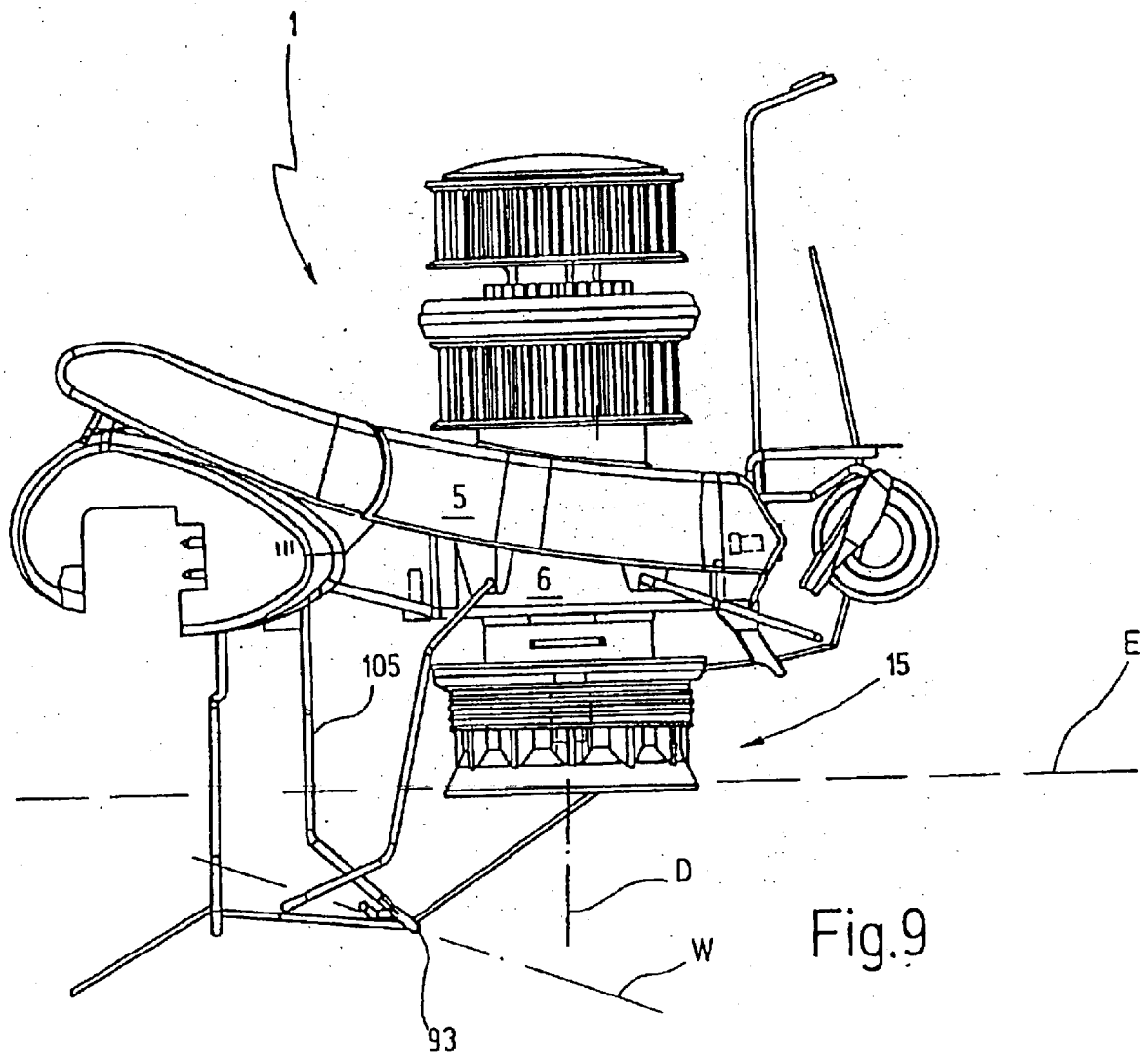
FIG. 9 is a side elevational view, similar to FIG. 8, showing the yarn feeder set for use with continuous-filament yarn.

The yarn feeder 1 has an adjustable yarn guide arrangement for the yarn guide eyelet 93. To explain the structure and function, reference will be made below to FIGS. 8 through 11. As seen from FIGS. 8 and 9, the yarn guide eyelet 93 can be moved to at least two different positions and locked in those positions. In the first position, shown in FIG. 8, the yarn guide eyelet 93 is located a short distance below a plane E, defined by the lower rim of the yarn guide drum 15, and is retained at a relatively large spacing from the pivot axis D of the drum. The preferably rectilinear path W along which the yarn guide eyelet 93 is adjustable or displaceable forms an acute angle with the pivot axis D, as shown in FIG. 9.

Figure 10:
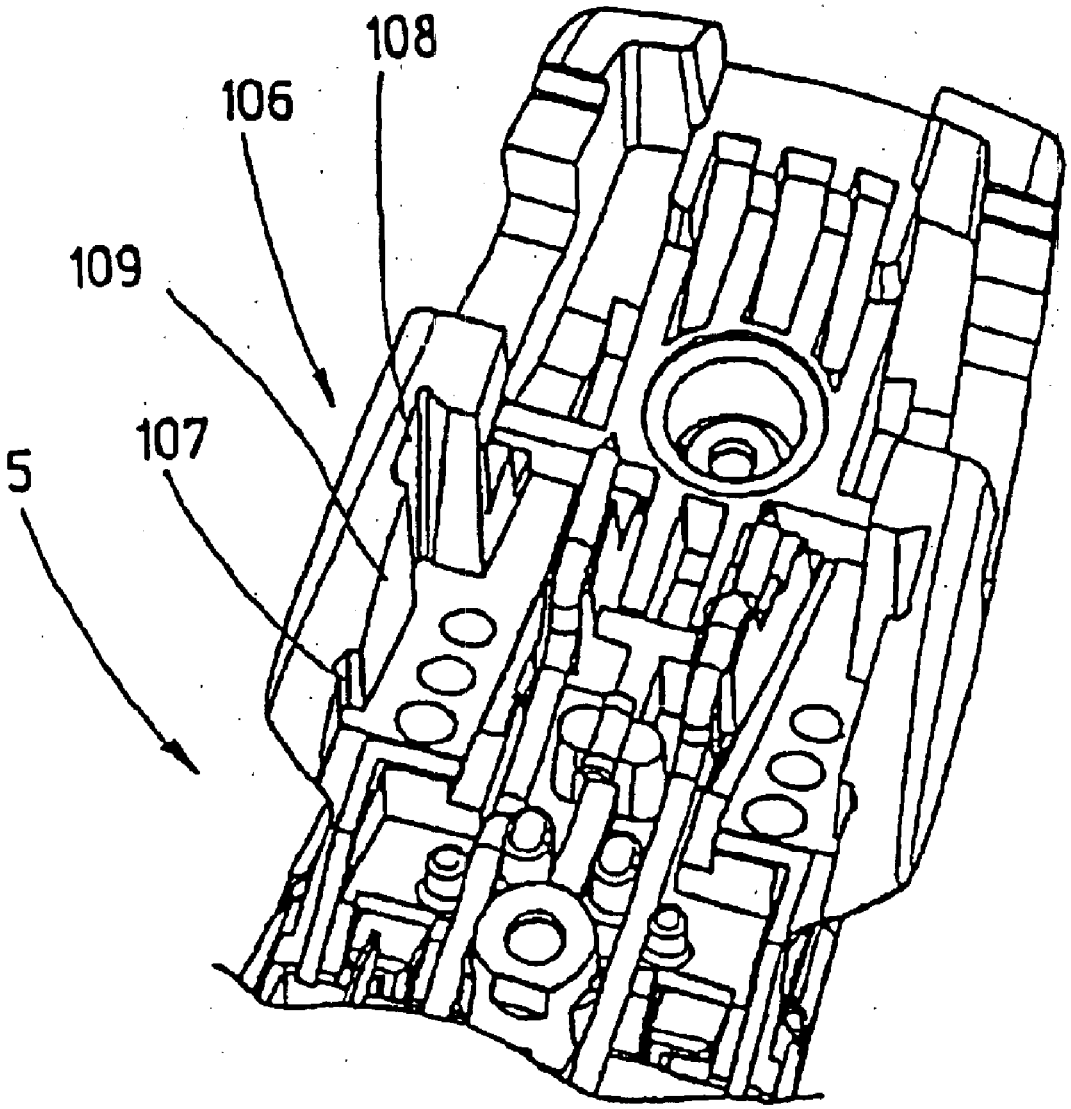

The yarn guide eyelet 93 is carried by two substantially parallel wire legs 105 extending away from it, which are guided in a slot 106 formed in the housing. The slot 106, as shown in FIGS. 10 and 11, is formed between the upper housing part 5 and the lower housing part 6. For each leg 105, there is one slot 106 on each side of the housing. In FIGS. 10 and 11, the same reference numerals are therefore used for the slots 106 and their details, and the description applies equally to both slots 106.

The slot 106 includes a pocket, which is formed between the upper housing part 5 and the lower housing part 6 and is open toward the bottom. The pocket is formed on the part of the housing part 5 by two groove-like or channel-like indentations 107, 108, between which a protrusion 109 is formed that is aimed at a corresponding cheek 111 of the lower housing part 6. Between the cheek ill and the protrusion 109, however, a gap remains, through which the applicable wire leg 105 can be thrust. The wire legs 105 yield outward, however, so that on both ends of their path, which are formed by the indentations 107, 108, they snap into place. The channel-like indentations 107, 108 are thus both detent and guide means at the same time, because they support the wire legs 105 nonpivotably. The wire legs 105 are also seated axially nondisplaceably in the slot 106. To that end, ends bent inward or angled in some other way are formed on the wire legs 105 and engage the cheek 111, for instance, from behind, the cheek being embodied as flat itself and extending between to outward-protruding ribs 114, 115. As needed, the ribs 114, 115 can either engage the indentations 107, 108 or adjoin them. The narrow ribs 114 can for instance engage the indentation 108 and thus with their inner flank can determine the alignment of the wire leg 105. The vertical orientation of the yarn guide eyelet 93 is thus associated with the lower housing part 6. The yarn guide eyelet 93 preferably allows a certain lateral play for the yarn but is disposed centrally on the housing. The yarn 2 traveling away from the yarn guide eyelet 93 and the pivot axis of the yarn guide drum 19 are thus preferably both located in the same plane. The yarn feeder of FIG. 1 described thus far functions as follows:

In operation, the yarn 2 is put in place and threaded into the yarn feed, as shown. The yarn 2 extends through the inlet eyelet 74, through the space between the brake plates 71, 72, to the yarn eyelet 78, and the yarn 2 in the interstice holds a yarn feeler lever 100, here supported pivotably, in a raised position. Beginning at the yarn eyelet 78, the yarn 2 passes in multiple windings around the yarn guide drum 15 and then travels, obliquely sweeping the lower rim of the drum to the textile machine via the yarn guide eyelets 93, 94. Between the yarn guide eyelets 93, 94, a further yarn feeler lever 101 rests on the yarn, in order to monitor its tension. The yarn feeler lever 101 is connected to a switch, which furnishes a switching signal whenever the yarn feeler lever 101 drops below a minimum height.

The yarn feeler lever 101 is disposed such that when the yarn is held taught, in each setting position of the yarn guide element 93, it is held in the same or at least nearly the same position. The rated position of the feeler lever 101 is as a result independent of the setting of the yarn guide element 93. This is attained by means of a pivotable bearing of the yarn feeler lever 101 in the vicinity of the pivot axis D and by a relatively long lever length; the yarn 2 is scanned in the vicinity of the fixed yarn guide eyelet 94. If needed, further yarn feeler elements may be provided, whose rated and switching positions are equally unaffected by the adjustment of the adjustable yarn guide arrangement.

In operation, the yarn guide drum 15 is driven to rotate and thus feeds specified quantities of yarn. For instance, if a spun yarn, which has relatively many filaments protruding from the yarn, is to be processed, then the setting of the yarn feeder 1 as shown in FIG. 8 is preferred. The yarn guide eyelet 93 here is in an upper position at a relatively slight spacing below the plane B, but at a greater spacing from the pivot axis D. The yarn 2 is drawn off relatively shallowly and thus deviates rather slowly from the package located on the yarn guide drum 15. This prevents the yarn 2 being paid out from tearing windings of the package downward.

If a comparatively smooth continuous-filament yarn is to be processed, then the yarn 2 is torn off upstream of the yarn feeder 1, and the new yarn is knotted to the end of the old yarn. Furthermore, for setting to the smoother continuous-filament yarn, the yarn guide eyelet 93 is transferred downward to the position shown in FIG. 9, in which it is farther away from the plane B but in turn closer to the pivot axis D. This spacing, however, is still greater than the diameter of the lower rim of the yarn guide drum 15. The yarn is now drawn off relatively steeply, so that it reliably sweeps over the rim of the yarn guide drum 15 and strips off any fluff or the like present there.

For adjusting the yarn guard eyelet, the wire legs 105 are pressed together, counter to their own spring force, so that they emerge from the respective indentations 107 and 108 (see FIG. 10). The element formed by the yarn guide eyelet 93 and the wire legs 105 can be displaced in this condition along the path W. Once it is released at the end of the path, the wire legs 105 snap back into the respective indentations 107 or 108, and the yarn guide eyelet 93 is locked in its new position. The path W can be linear, or in other words a straight line. If needed, it can also be curved, for instance by disposing the yarn guide eyelet 93 on the end of a pivotably supported arm.

If needed, intermediate positions can be provided, by forming suitable grooves in the protrusions 109. If the yarn guide drum 15 is replaced with the friction unit 80 of FIG. 7, then the yarn 2 wrapping around the friction disk 81 is correspondingly carried along and advanced. Replacing the yarn guide drum 15 with the friction unit 80 thus makes it possible to vary the functional principle.

Figure 5:
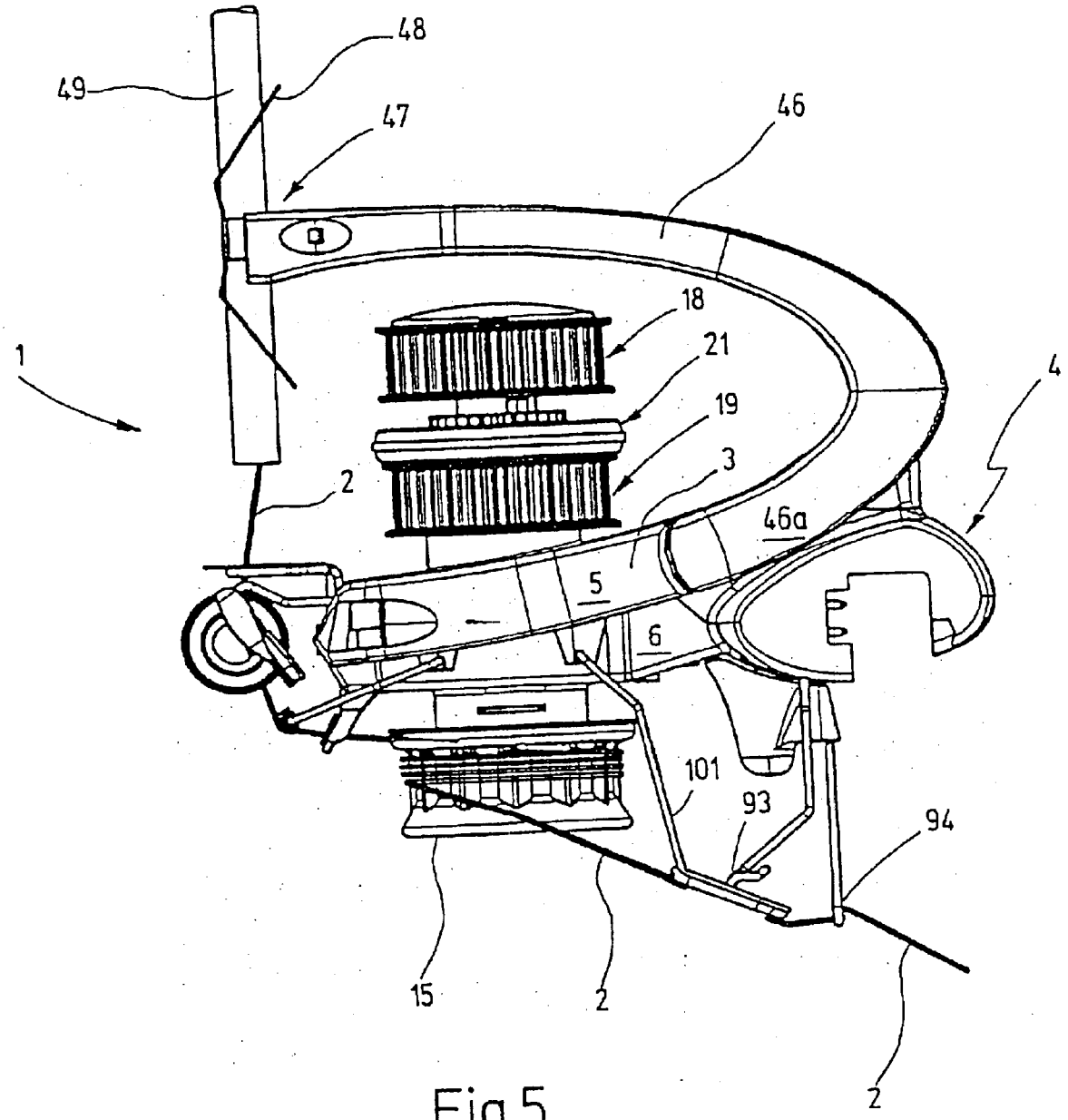
FIG. 5 is a side elevational view of the illustrated yarn feeder equipped with a retainer for a yarn guide tube.

The brake module 51 can also be replaced by a non-driven yarn brake module. The yarn feeder 1 can also be refitted by removing the blind cap 41 and replacing it with the arm 46 (FIG. 5).

From the foregoing, it can be seen that in the modular yarn feeder 1, the basic carrier 3 is a basic component of the apparatus on which additional modules can be secured as needed by suitable coupling devices. This makes the yarn feeder more adaptable to different kinds of use and situations.

What is claimed is:

1. A yarn feeder (1) for textile machines comprising:

a basic carrier (3) having a fastening device (4) for enabling connection of the basic carrier (3) to the textile machine, a shaft (14) pivotally supported by the basic carrier (3) for movement about an axis of rotation D, a yarn guide drum (15) mounted on said shaft, said yarn guide drum (15) having a yarn inlet side and a yarn outlet side (14), a drive device (18) connected to said shaft (14), at least one adjustable yarn guide device (25) having a yarn guide element (93) disposed on a yarn outlet side of said yarn guide drum (15), said yarn guide element (93) being adjustable between at least two positions below a lower perimeter of said yarn guide drum (15) including a first position first distances below the lower drum perimeter and a side of said axis of rotation D and a second position second distances below the lower drum perimeter and a side of said axis of rotation D different from said first distances such that in either of said positions of the yarn guide drum (15) yarn can be obliquely drawn from the yarn guide drum (15).

2. The yarn feeder of claim 1 in which said yarn guide element (93) is an eyelet.

3. The yarn feeder of claim 1 in which said yarn guide element (93) is adjustably supported for movement in a straight path (W) inclined relative to a pivot axis (D) of said shaft, and at least two detents defining specific positions of said guide element (93).

4. The yarn feeder of claim 1 in which said yarn guide element (93) in a first of said two positions said yarn guide drum (15) and away from a pivot axis (D) of said shaft, and in the other of said positions is located at a relatively greater spacing below said yarn guide drum (15) and a relatively closer spaced relation to said pivot axis (d) than in said first position.

5. The yarn feeder of claim 1 in which said yarn guide element (93) is supported in a sliding block guide.

6. The yarn feeder of claim 1 including a yarn feeler lever (100) for sensing the tension of yarn traveling through said adjustable yarn guide element (93), and said yarn feeler level being connected to a switching device.

7. The yarn feeder of claim 6 in which said switching device has a fixed switching point which is operable independent of the position of the yarn guide element (93).

8. The yarn feeder of claim 1 including at least one coupling device (25) for fastening additional modules on the basic carrier (3).

9. The yarn feeder of claim 8 including an additional module (46) in the form of a retainer on which further yarn processing elements (49) can be secured.

10. The yarn feeder of claim 8 in which said coupling device (25) has a blind cap (41) for covering the coupling when not in use.

11. The yarn feeder of claim 1 in which said coupling device (25) includes a guide device (28) having a guide body and a chucking device (36, 38), said guide body (28) being deformable for clamping a counterpart (46*a*).

12. The yarn feeder of claim 1 in which said basic carrier (3) is a two-shell housing.

13. The yarn feeder of claim 1 including a cover hood (79) between the basic carrier (3) and the yarn guide drum (15) which fits over the yarn guide drum on its rim.

14. A modular yarn feeder (1) for textile machines comprising:

a basic carrier (3) having a fastening device (4) for enabling connection of the basic carrier (3) to the textile machine, a shaft (14) pivotally supported by the basic carrier (3), a yarn guide drum (15) mounted on such shaft and having a yarn inlet side and a yarn outlet side (14), a drive device (18) connected to said shaft (14), at least one adjustable yarn guide device (25) having a yarn guide element (93) disposed on a yarn outlet side of said yarn guide drum (15), said yarn guide element (93) being adjustable between at least two positions below said yarn guide drum (15) such that in either position of the yarn guide drum (15) yarn can be obliquely drawn from the yarn guide drum (15), a sliding block guide for supporting said yarn guide element (93), said sliding block guide having two legs (105) extending away from the yarn guide element for yielding movement toward and away from one another, and said basic carrier (3) being formed with a pocket for engagement by said legs (105).

15. A yarn feeder (1) for textile machines comprising:

a basic carrier (3) having a fastening device (4) for enabling connection of the basic carrier (3) to the textile machine, a shaft (14) pivotally supported by the basic carrier (3) for movement about an axis of rotation D, a yarn guide drum (15) mounted on said shaft, said yarn guide drum (15) having a yarn inlet side, a yarn outlet side (14) and a lower perimeter in a plane substantially perpendicular to said axis of rotation D, a drive device (18) connected to said shaft (14), at least one adjustable yarn guide device (25) having a yarn guide element (93) disposed on a yarn outlet side of said yarn guide drum (15), said yarn guide element (93) being adjustable between at least two positions below said yarn guide drum (15) including a first position first distances below said plane of the lower drum perimeter and a side of said axis of rotation D, and a second position second distances below said plane of the lower drum perimeter and a side of said axis of rotation D different from said first distances such that in either of said positions of the yarn guide drum (15) yarn can be obliquely drawn from the yarn guide drum (15).

16. A yarn feeder (1) for textile machines comprising:

a basic carrier (3) having a fastening device (4) for enabling connection of the basic carrier (3) to the textile machine, a shaft (14) pivotally supported by the basic carrier (3) for movement about an axis of rotation D, a yarn guide drum (15) mounted on said shaft, said yarn guide drum (15) having a yarn inlet side and a yarn outlet side (14) and a lower perimeter in a plane substantially perpendicular to said axis of rotation D, a drive device (18) connected to said shaft (14), at least one adjustable yarn guide device (25) having a yarn guide element (93) disposed on a yarn outlet side of said yarn guide drum (15), said yarn guide element (93) being adjustable between at least two positions in a line inclined both to said plane of the lower perimeter of said drum and to said axis of rotation such that in either of said positions of the yarn guide drum (15) yarn can be obliquely drawn from the yarn guide drum (15) in a line inclined both to said plane of the lower perimeter of said drum and to said axis of rotation.

* * * * *